US011434843B1

(12) United States Patent
Baramov et al.

(10) Patent No.: US 11,434,843 B1
(45) Date of Patent: Sep. 6, 2022

(54) ENGINE MASS FLOW OBSERVER WITH FAULT MITIGATION

(71) Applicant: Garrett Transportation I Inc., Torrance, CA (US)

(72) Inventors: Lubomir Baramov, Prague (CZ); Jaroslav Pekar, Pacov (CZ); Paul Dickinson, Bristol (GB); Tomas Poloni, Malinovo (SK)

(73) Assignee: Garrett Transportation I Inc., Torrance, CA (US)

( * ) Notice: Subject to any disclaimer, the term of this patent is extended or adjusted under 35 U.S.C. 154(b) by 0 days.

(21) Appl. No.: 17/327,066

(22) Filed: May 21, 2021

(51) Int. Cl.

| | |
|---|---|
| ***F02D 41/22*** | (2006.01) |
| ***F01N 11/00*** | (2006.01) |
| ***F02M 26/49*** | (2016.01) |
| ***F01N 13/10*** | (2010.01) |
| ***F02M 26/04*** | (2016.01) |

(52) U.S. Cl.
CPC ..... *F02D 41/22* (2013.01); *F01N 11/007* (2013.01); *F01N 13/10* (2013.01); *F02M 26/04* (2016.02); *F02M 26/49* (2016.02); *F02D 2200/04* (2013.01)

(58) Field of Classification Search
CPC ..... F02D 41/22; F02D 2200/04; F02D 2200/0402; F02D 2041/1411; F02D 2041/1433; F02D 2041/1434; F02D 2041/1436; F02N 11/007; F01N 13/10; F02M 26/04; F02M 26/49
See application file for complete search history.

(56) References Cited

U.S. PATENT DOCUMENTS

| | | | | |
|---|---|---|---|---|
| 8,700,546 | B2 | 4/2014 | Germann et al. | |
| 10,184,439 | B2 | 1/2019 | Claude et al. | |
| 10,364,764 | B2 | 7/2019 | Wang et al. | |
| 10,619,582 | B2 | 4/2020 | Lutz et al. | |
| 10,641,214 | B2 | 5/2020 | Dudar | |
| 2013/0042609 | A1* | 2/2013 | Cianflone ..... | F02B 37/18 73/114.77 |
| 2018/0149064 | A1 | 5/2018 | Pachner et al. | |

(Continued)

FOREIGN PATENT DOCUMENTS

| | | | | |
|---|---|---|---|---|
| GB | 2483729 A | * | 3/2012 | ..... F02D 41/0007 |

OTHER PUBLICATIONS

U.S. Appl. No. 17/008,076 and the entirety of the application filed Aug. 31, 2020.

(Continued)

*Primary Examiner* — George C Jin
(74) *Attorney, Agent, or Firm* — Seager, Tufte & Wickhem, LLP

(57) ABSTRACT

Methods and systems for fault mitigation in an engine system. For ordinary operation, a set of control signals are generated after calculating airflows within the engine system using a set of flow models linked to components of the engine system, while underweighting or omitting an output of a sensor in the engine system. When a fault is identified, the set of flow models is analyzed differently by under-weighting or omitting one or more flow models in favor of using the sensor output. By so doing, the engine system can continue to be operated without triggering an on-board diagnostic alert requiring cessation of operation.

20 Claims, 6 Drawing Sheets

Fig. 4A

(56) References Cited

U.S. PATENT DOCUMENTS

2020/0369284 A1* 11/2020 Chen ..... B60W 30/14

OTHER PUBLICATIONS

U.S. Appl. No. 16/951,208 and the entirety of the application filed Nov. 18, 2020.
Liu et al., "Modeling and Control of a Power-Split Hybrid Vehicle," IEEE Transaction on Control Systems Technology, vol. 16 (6), p. 1242-1251, Nov. 2008.

* cited by examiner

ENGINE MASS FLOW OBSERVER WITH FAULT MITIGATION

BACKGROUND

Tightening emissions controls on internal combustion engines have been addressed in some architectures by the use of exhaust gas recirculation (EGR) valves that recirculate exhaust gasses to the airstream going into the engine combustion chambers. In order to efficiently and/or effectively manage emissions outputs, EGR mass flow and engine air mass flow need to be measured or otherwise understood. Moreover, the entire system needs to be observed for faults during operation, as faults can lead to the crossing of emissions thresholds. If an emissions threshold is crossed, this can trigger an on-board diagnostics (OBD) alert, which in turn may necessitate cessation of vehicle operation driving up the costs associated with the fault. New and/or alternative approaches that enable early identification and mitigation of faults without waiting for emissions changes and responsive OBD alerts are desired.

OVERVIEW

The present inventors have recognized, among other things, that a problem to be solved is the need for new and/or alternative approaches to fault mitigation that can take place without reliance on emissions and/or OBD alerts.

A first illustrative and non-limiting example takes the form of a method of operating an engine system having an engine and an airflow system associated with the engine, the method comprising: calculating a plurality of parameters within the engine system using a model set including a plurality of models for components within the system, the components including at least a turbocharger having a compressor and a turbine, an exhaust gas recirculation (EGR) valve, and an aftertreatment system including a Lambda sensor, the models including a flow model for the EGR valve, one or more flow models for the turbine, and a charge flow model for air entering an intake manifold of the engine, as part of an ordinary operation of the engine system; during said ordinary operation of the engine system, using the calculated plurality of parameters to implement a plurality of control signals on components of the engine system; identifying a fault in a component of the engine system; and responsive to the fault: calculating the plurality of parameters using a modified model set that omits or underweights at least one of the plurality of models, by incorporating an additional sensed measurement value which is either omitted or underweighted when calculating the plurality of parameters during the ordinary operation; and using the calculated plurality of parameters using the modified model set to implement a plurality of control signals on the components of the engine system.

Additionally or alternatively, the plurality of parameters comprises each of an EGR valve mass flow, a mass of fresh air entering the engine system, and a burned fuel fraction present in exhaust exiting the engine system.

Additionally or alternatively, the turbine is a twin scroll turbine; the engine comprises a first exhaust manifold coupled by a first path to a first section of the twin scroll turbine, and a second exhaust manifold coupled by a second path to a second section of the twin scroll turbine; a balance valve links the first and second paths; the first path is coupled to the EGR valve; the additional sensor is an exhaust manifold pressure sensor; and the one or more flow models for the turbine comprise a first flow model for the first path, a second flow model for the second path, and a balance valve flow model.

Additionally or alternatively, the fault is identified in the balance valve; and the reduced model set omits or underweights the EGR flow model.

Additionally or alternatively, the fault is identified in the aftertreatment; the reduced model set omits or underweights the aftertreatment flow balance.

Additionally or alternatively, the fault is identified in the EGR valve; and the reduced model set omits or underweights the first flow model for the first path.

Additionally or alternatively, the engine comprises an exhaust manifold, and the additional sensor is an exhaust manifold pressure sensor.

Additionally or alternatively, the engine system comprises a turbocharger having a compressor for compressing air entering the engine, and a turbine for receiving exhaust gasses and obtaining torque to drive the compressor, and the additional sensor is a turbocharger speed sensor.

Additionally or alternatively, identifying the fault comprises observing or sensing whether an actuator has failed to actuate a component controlled by the actuator.

Additionally or alternatively, identifying the fault comprises observing whether actuation of a component fails to cause a change in a sensed or calculated parameter that would otherwise be expected.

Another illustrative, non-limiting example takes the form of an engine system comprising: an engine having an intake manifold and an exhaust manifold, with a combustion chamber therebetween into which a fuel quantity is provided; an airflow system associated with the engine, the airflow system having at least a turbocharger having a compressor and a turbine, an exhaust gas recirculation (EGR) valve; an aftertreatment system including a Lambda sensor; and an engine control unit (ECU) storing in a non-transitory memory a plurality of models of components of the engine system including a flow model for the EGR valve, one or more flow models for the turbine, and a charge flow model for air entering the intake manifold of the engine, the ECU configured to operate as follows: calculating a plurality of parameters within the engine system using a the flow model for the EGR valve, the one or more flow models for the turbine, and the charge flow model for air entering an intake manifold of the engine, as part of an ordinary operation of the engine system; implementing a plurality of control signals on components of the engine system using the calculated plurality of parameters; identifying a fault in a component of the engine system; and, responsive to the fault: calculating the plurality of parameters using a modified model set that omits or underweights at least one of the plurality of models, by incorporating an additional sensed measurement value which is either omitted or underweighted when calculating the plurality of parameters during the ordinary operation; and implementing a plurality of control signals on components of the engine system using the calculated plurality of parameters determined from the modified model set.

Additionally or alternatively, the plurality of parameters comprises each of an EGR valve mass flow, a mass of fresh air entering the engine system, and a burned fuel fraction present in exhaust exiting the engine system.

Additionally or alternatively, the turbine is a twin scroll turbine having a first section and a second section; the engine comprises a first exhaust manifold and a second exhaust manifold; the airflow system comprises a first airflow path from the first exhaust manifold to the first section of the twin scroll turbine, and a second airflow path from the second exhaust manifold to the second section of the twin scroll turbine, and a balance valve linking the first and second airflow paths; the first path is coupled to the EGR valve; the additional sensor is an exhaust manifold pressure sensor; and the one or more flow models for the turbine comprise a first flow model for the first path, a second flow model for the second path, and a balance valve flow model.

Additionally or alternatively, the ECU is configured to identify a fault in the balance valve, and, in response thereto, to use a reduced model set that omits or underweights the EGR flow model.

Additionally or alternatively, the ECU is configured to identify a fault in the aftertreatment, and, in response thereto, to use a reduced model set that omits or underweights the aftertreatment flow balance.

Additionally or alternatively, the ECU is configured to identify a fault in the EGR valve, and, in response thereto, to use a reduced model set that omits or underweights the first flow model for the first path.

Additionally or alternatively, the engine comprises an exhaust manifold, and the additional sensor is an exhaust manifold pressure sensor.

Additionally or alternatively, the engine system comprises a turbocharger having a compressor for compressing air entering the engine, and a turbine for receiving exhaust gasses and obtaining torque to drive the compressor, and the additional sensor is a turbocharger speed sensor.

Additionally or alternatively, the ECU is configured to identify the fault by observing or sensing whether an actuator has failed to actuate a component controlled by the actuator.

Additionally or alternatively, the ECU is configured to identify the fault by observing whether a command issued to actuate a component fails to cause a change in a sensed or calculated parameter that would otherwise be expected.

This overview is intended to provide an introduction to the subject matter of the present patent application. It is not intended to provide an exclusive or exhaustive explanation. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
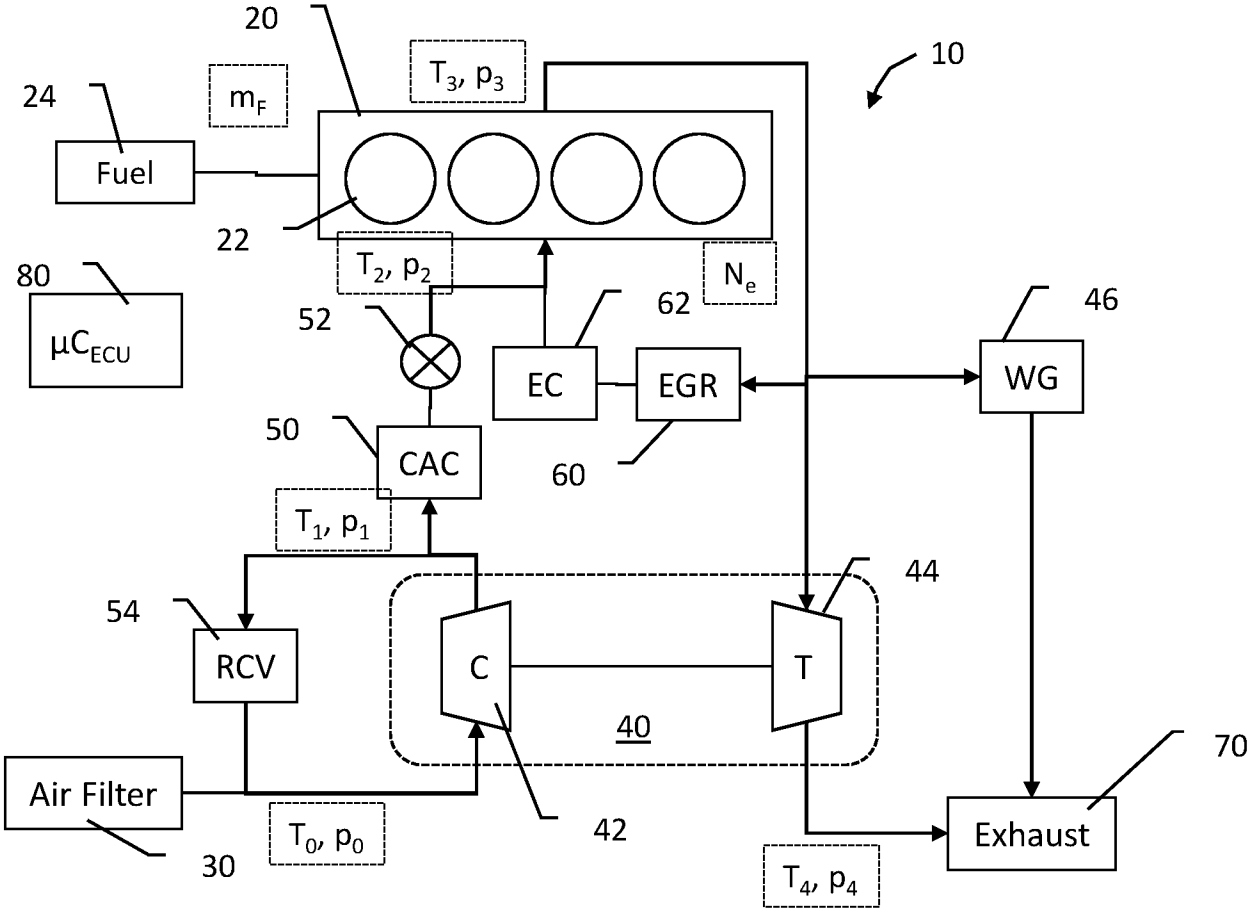
FIG. 1 shows an illustrative engine with a turbocharger.

FIG. 1 shows an illustrative engine with a turbocharger. The system 10 includes an engine 20 having one or more cylinders 22, which receives fuel from a fuel system 24, such as by one or more fuel injectors. The fuel system 24 provides a known or set quantity of fuel for each firing of each cylinder 22, making for a determined quantity of fuel for each full firing sequence of the engine's cylinders. The speed of the engine, $N_E$, represents the speed at which a full firing sequence takes place (whether or not all cylinders are active).

The airflow of the system includes fresh air intake passing through an air filter 30 and then going to a turbocharger 40 having a compressor 42 and turbine 44 linked together by a drive shaft. Air exiting the compressor 42 is considered the "charged" air flow, having been compressed, and it passes through a charge air cooler 50 to reduce temperature, and then to a throttle 52. To prevent turbocharger surge (reverse airflow through the compressor 42 which can be caused by pressure imbalances responsive to closing of the throttle 52), a recirculation valve 54 is provided to allow charged air to recirculate back to the compressor 42 input.

After passing through the throttle 52, the charged fresh air reaches the intake manifold of the engine 20, where combustion takes place. Prior to entering the intake manifold the charged fresh air mixes with recirculated exhaust gasses that pass through an exhaust gas recirculation (EGR) valve 60, which will typically also pass the recirculated gas through an EGR Cooler 62. The recirculated exhaust gas aids in reducing combustion temperatures in the engine 20, reducing certain noxious emissions.

During combustion the charged air mass is combined with the fuel mass, $m_F$. Exhaust gasses leave the engine at an exhaust manifold. Exhaust gasses are then directed to the turbine 44, which obtains torque/force from the exhaust gas that is in turn applied via the drive shaft to the compressor 42. In some examples the speed of rotation of the turbocharger drive shaft is a measured variable, referred to as turbocharger speed.

A wastegate 46 allows venting of exhaust gas without passing through the turbine 44 to control turbocharger speed. Rather than a wastegate 46, a variable geometry turbine (VGT) may be used to manage gasses entering the turbine 44, if desired. Gasses exiting the system either via the turbine 44 or the wastegate 46 go to an exhaust structure 70 where various aftertreatment devices may remove or reduce pollutants. One or more lambda sensors or universal exhaust gas oxygen (UEGO) sensors are provided in the exhaust structure 70. The measured oxygen concentration can be used to determine air to fuel ratio in the engine 20, for example.

Small boxes are shown throughout the figure representing temperature and pressure at various locations:

$T_0$, and $p_0$ represent the ambient air temperature and air pressure $T_1$, and $p_1$ represent pressure and temperature at the outlet of the compressor 42;

$T_2$, and $p_2$ represent pressure and temperature at the intake manifold;

$T_3$, and $p_3$ represent pressure and temperature at the exhaust manifold; and $T_4$, and $p_4$ represent pressure and temperature at the outlet of the turbine 44.

In a production system, the ambient air temperature and pressure ($T_0$, and $p_0$), and the intake manifold pressure and temperature ($T_2$ and $p_2$) may be measured parameters, and other pressures and temperatures are estimated, calculated and or inferred using a model of the system and other characteristics. Engine speed ($N_E$) will also be known, as is the mass input via the fuel injectors of the engine 20, and the output of the lambda sensor at the exhaust structure 70. In some examples, $p_3$ may also be directly measured, and/or the turbocharger speed may be measured.

In a system under test, such as one used for modelling the system or one being tested at a test stand, additional sensors and pressures may be captured throughout the system. The added sensors aid in the development and calibration of models used in production systems to estimate, calculate or infer the various pressures, temperatures, mass flows, etc. as needed.

The operation in general is controlled by an engine control unit (ECU) 80. The ECU may include a microcontroller or microprocessor, as desired, or other logic/memory, application specific integrated circuit (ASIC), etc., with associated memory for storing observed characteristics as well as operational instruction sets in a non-transitory medium, such as a Flash or other memory circuitry. The ECU 80 will be coupled to various actuators throughout the system, as well as to the provided sensors, to obtain data and issue control signals as needed. The ECU may couple to other vehicle control systems such as by a controller area network (CAN) bus or other wired or wireless link.

FIG. 1 illustrates an example which is more or less typical for a diesel engine configuration, with the EGR 60 in a "high pressure" location, recirculating exhaust gasses from the exhaust manifold to the intake manifold of the engine 20. Other fuels and configurations may be used instead. For example, a gasoline engine may use a low pressure EGR 60, which would link the output of the turbine 44 to the input of the compressor 42 using a low pressure EGR valve, or even using a three-way valve taking as inputs the incoming air from the air filter 30 as well as filtered and cooled recirculated exhaust gasses exiting the turbine 44, with an output entering the compressor 42. Additional elements may be present, such as by including an electric motor (E-Turbo) that applies added force as commanded to the drive shaft of the turbocharger 40, and one or more features can be omitted or swapped out, such as by replacing the RCV with a blow-off valve that vents charged air to the atmosphere rather than recirculating it, or any other suitable changes.

Figure 2:
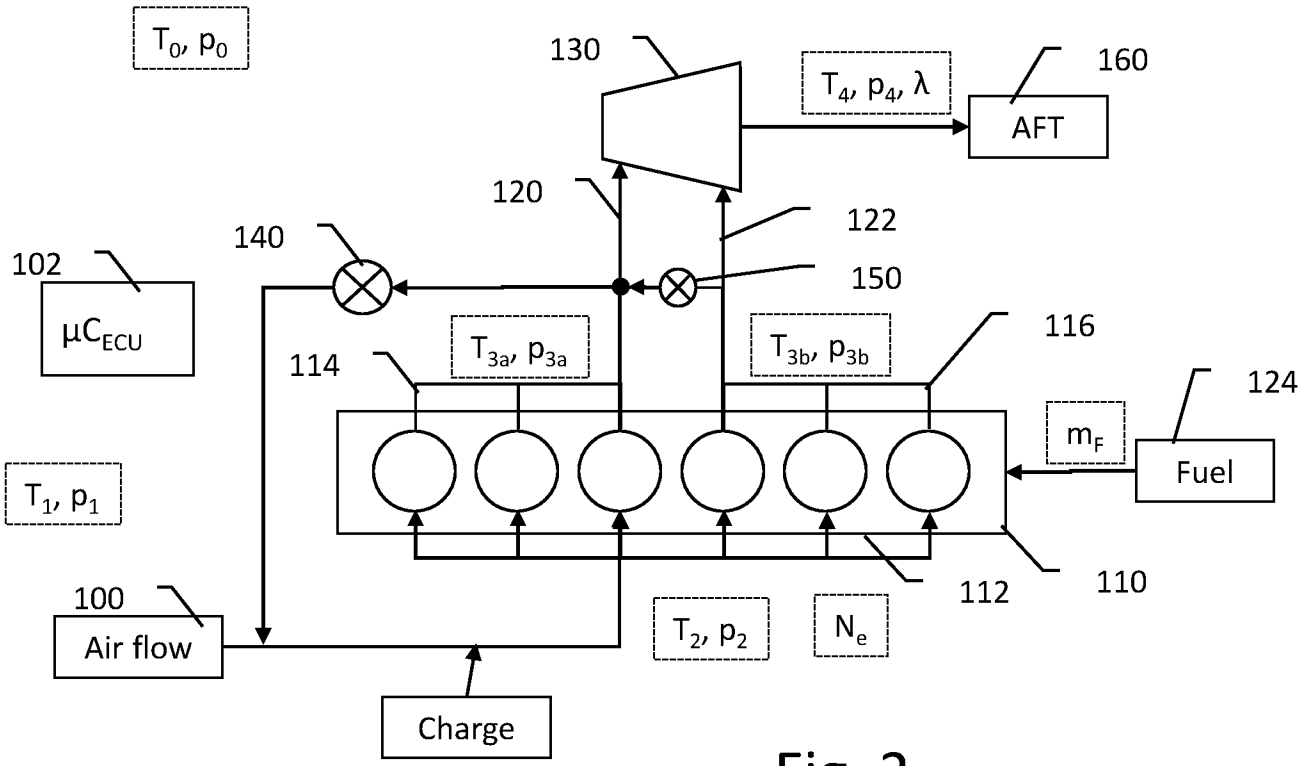
FIG. 2 shows an illustrative engine with a twin scroll turbine.

FIG. 2 shows an illustrative engine with a twin scroll turbine. One of the known tradeoffs with a standard turbocharger setup as shown in FIG. 1 is that of low-speed responsiveness and high-speed efficiency. When the engine operates at low speeds, the quantity of exhaust gas generated may drive the turbocharger turbine at relatively low speed itself. A command to increase engine speed will cause more exhaust gas to flow, however, the rotational inertia of the turbocharger system components will delay the turbocharger's response. The tradeoff is that one can improve responsiveness using a smaller turbocharger to reduce rotational inertia, but that change can reduce efficiency at high speeds. A twin-scroll turbocharger splits the exhaust gasses and applies a portion of exhaust gasses to a first part of the turbine, and another portion of the exhaust gasses to a different part of the turbine, improving responsiveness at low speeds without sacrificing efficiency at high speeds.

In FIG. 2, air flow is shown coming into the system at 100 (after exiting a compressor, and charge air cooler, as desired), combining with EGR flow and entering the intake manifold for a six-cylinder engine 110 (any number of cylinders may be present; typically, an even number such as 4, 6, or 8). The system components as shown are controlled by one or more ECUs 102. At the exhaust manifold, the exhaust air is split, with some of the cylinder outputs ganged together at 114 and routed via a first exhaust path 120, and the remaining cylinder outputs ganged together at 116 and routed via a second exhaust path 122. The engine receives fuel from a fuel system 124 as before, providing a fuel mass, $m_F$. The first exhaust path 120 is directed to a first portion of the vanes of the turbine 130, and the second exhaust path 122 is directed to a second portion of the vanes of the turbine 130, as illustrated. A balance valve 150 is provided between the two exhaust paths 120, 122, and may be opened and/or closed as needed to balance the exhaust gas flow and/or pressure. Exhaust gasses can then exit the turbine 130, to the aftertreatment 160, as illustrated.

In this example, an EGR valve (high pressure) is shown at 140, recirculating exhaust gasses to mix with the air flow 100. The EGR valve 140 links to the first exhaust path 120, as shown. The balance valve 150 can be used to equalize pressure as needed meaning that not all of the recirculated exhaust would necessarily come from the first exhaust path 120.

The following variables are noted on FIG. 2:

$T_0$, and $p_0$ represent the ambient air temperature and air pressure;

$T_1$, and $p_1$ represent pressure and temperature at the outlet of the compressor (not shown);

$T_2$, and $p_2$ represent pressure and temperature at the intake manifold;

$T_{3a}$, and $p_{3a}$ represent pressure and temperature at the exhaust manifold within the first exhaust path 120; and $T_{3b}$, and $p_{3b}$ represent pressure and temperature at the exhaust manifold within the second exhaust path 122; and $T_4$, and $p_4$ represent pressure and temperature at the outlet of the turbine 44.

Lambda sensor output and engine speed $N_E$ are also available variables. The twin scroll configuration incorporates additional mass flow variables (as compared to that of FIG. 1) by spitting the exhaust gas mass flow into two parts, and adding a balance mass flow through valve 150 to the overall analysis/system.

With either of the configurations in FIGS. 1 and 2, EGR mass flow can be measured using, for example, a Venturi-type sensor or an obstruction type flow meter. EGR mass flow could instead by computed by sensing the pressure at the exhaust manifold of the engine and, knowing the pressure differential between the exhaust manifold and the intake manifold, mass flow through the EGR can be calculated using a flow model for the EGR itself. Either sensor type and location (EGR flow sensor/meter, or exhaust manifold pressure sensor) increases system expense and complexity, and the added sensors are subject to failure in the high temperature, dirty environment. Using the exhaust manifold pressure is further complicated due to the inclusion of separate exhaust paths 120, 122 and balance valve 150.

The charge flow, that is the mass entering the intake manifold of the engine, is equal to the air flow (from the compressor) plus the EGR mass flow. The charge flow can be additionally characterized using the burned gas fraction, BGF, which is a function of the air flow, EGR mass flow, and injected fuel mass. BGF has a strong correlation to engine-out oxides of nitrogen (NOx) and is an important control variable.

In each of FIGS. 1 and 2, the EGR mass flow can be estimated and/or calculated without necessarily measuring mass flow through the EGR. For example, a virtual sensor model can infer total air flow throughout the system, with EGR flow then being the difference between air flow entering/exiting the compressor and charge flow into the intake manifold. A lambda sensor in the exhaust airstream, combined with knowledge of the injected fuel quantity, can be used to infer the EGR mass flow after solving for charge flow and air flow. With lean combustion, however, the lambda sensor is generally less accurate than would be desired, and the data provided by a lambda sensor is subject to delay. The virtual sensor model may be subject to error when pressure ratios are low, as the model relies on flow estimates that are based on pressure differences from one location to another in the system.

In some illustrative examples, the EGR mass flow is determined using a weighted combination of a virtual sensor and the lambda sensor. The weighted combination may use weighting coefficients that are dynamically modified in response to engine conditions. For example, with lean combustion and/or in transient conditions, weighting coefficients can be selected to favor the virtual sensor model. When pressure ratios calculated by the virtual sensor are low, the weighting coefficients can be selected to favor use of the lambda sensor. For example, when one factor or the other is "favored," the weighting coefficients can be selected so that the favored factor is the predominant input (greater than 50%, 75%, or 90% for example) of the resultant calculation.

The mass flows in the illustrative system of FIG. 2 can be modelled using a limited set of equations. Each variable/model can be formulated using a multivariate polynomial of the form:

$$P(u_1,u_2)a_0+a_1\cdot u_1+a_2\cdot u_2+a_3\cdot u_1^2+a_4\cdot u_1\cdot u_2+a_4\cdot u_2^2 \quad \{1\}$$

Third or more variables may be included, with expansion of similar structure. The models may also include or use a set of rational functions of a form:

$$R(u_1, u_2) = \frac{N(u_1, u_2)}{D(u_1, u_2)} \quad \{2\}$$

Where $N(u_1,u_2)$ and $D(u_1, u_2)$ are each polynomials of the form shown in Eq. 1. By generating each model as a multivariate and/or rational function as shown in Eq. 1 and Eq. 2, the underlying derivations and calculations will remain rational and can be accurately approximated with unbounded sensitivities. The analytical framework allows fast evaluation of the models and sensitivities. Within such models, error functions can be set to detect and handle any circumstance in which the denominators near zero.

The mass flows for a twin scroll design, as in FIG. 2, can be calculated using the following equations. The aftertreatment (AFT) mass flow is as shown in Equation 3:

$$m_{T1}(p_{3a},p_4,T_{3a})+m_{T2}(p_{3b},p_4,T_{3b})=m_{AFT}(p_4,p_0,T_4) \quad \{3\}$$

Where $m_{T1}$ and $m_{T2}$ represent mass flow into each scroll of the turbine, and $m_{AFT}$ is the exhaust/aftertreatment mass flow. The flow balance for Scroll 1 is as shown in Equation 4:

$$m_{T1}(p_{3a}, p_4, T_{3a}) + m_{EGR}(p_{3a}, p_2, T_{3a}, u_{EGR}) + m_{Bal}(p_{3a}, p_{3b}, T_{3a}, u_{Bal}) = \frac{1}{2}(m_{Ch}(p_2, m_f, T_2, N_e) + m_F) \quad \{4\}$$

Where $m_{EGR}$ is the EGR mass flow, $m_{Bal}$ is the mass flow through the balance valve, $m_{Ch}$ is the charge mass air flow, and $m_F$ is the fuel mass. The flow balance for Scroll 2 is shown by Equation 5:

$$m_{T2}(p_{3b}, p_4, T_{3b}) - m_{Bal}(p_{3a}, p_{3b}, T_{3a}, u_{Bal}) = \frac{1}{2}(m_{Ch}(p_2, m_f, T_2, N_e) + m_F) \quad \{5\}$$

The pressures $p_{3a}$, $p_{3b}$, and $p_4$ may be found by an iterative solver, such as a Gauss-Newton, Newton-Raphson, or iterated Kalman Filter. An exhaust manifold pressure sensor is optional in these equations. When the exhaust manifold pressure sensor is present, Equation 6 can be used as further discussed below in mitigation of one or more failure modes:

$$p_{3a}=p_{3a_sensor} \quad \{6\}$$

Because the system state can be solved without the exhaust manifold sensor, the inclusion of such a sensor can be used for the mitigations described below.

The total mass of incoming air flow ($m_A$) into the system can be determined using Equation 7:

$$m_A=m_{T1}(p_{3a},p_4,T_{3a})+m_{T2}(p_{3b},p_4,T_{3b})-m_F \quad \{7\}$$

Or, alternatively as shown in Equation 8:

$$m_A=m_{AFT}(p_4,p_0,T_{3a})-m_F \quad \{8\}$$

And the EGR mass flow would then be as shown in Equation 9:

$$m_{EGR}=m_{Ch}(p_2,m_F,T_2,N_e)-m_A \quad \{9\}$$

The equations are somewhat simpler with a single scroll turbine. The turbine outlet flow balance can be understood from Equation 10:

$$m_T(p_3,p_4,T_3,u_T)=m_{AFT}(p_0,p_4,T_4) \quad \{10\}$$

Where $u_T$, now included in the equation, is a turbine flow controlling actuator position, such as the wastegate or a variable geometry turbine (VGT). The mass flow balance can be understood from Equation 11:

$$m_T(p_3,p_4,T_3,u_T)+m_{EGR}(p_2,p_3,T_3,u_{EGR})=m_{Ch}(p_2,m_F,T_2,N_e)+m_F \quad \{11\}$$

If desired, the charge mass may also be calculated with the inclusion of measured $p_3$ (to the extent it is available) as one of the parameters. Again, pressure $p_3$ and $p_4$ are found by an iterative solver, such as a Gauss-Newton, Newton-Raphson, or iterated Kalman Filter. The exhaust manifold pressure sensor is optional in these equations. Inclusion of the $p_3$ sensor can be used for fault identification and/or mitigation, using Equation 12:

$$p_3=p_{3_sensor} \quad \{12\}$$

The incoming air flow can be calculated for the single scroll turbine using Equation 13 or 14:

$$m_A=m_T(p_3,p_4,T_3,u_{Tr,b})-m_F \quad \{13\}$$

Or, alternatively:

$$m_A=m_{AFT}(p_4,p_0,T_3)-m_F \quad \{14\}$$

And the EGR mass flow is again the same as in Equation 9, above.

The data extraction for the twin-scroll turbine model, and particularly with reference to the balance valve flow, will depend on accuracy of turbine flow mapping, EGR valve modelling, and the charge flow model. With that many inputs, the data output can be uncertain. In some examples, the exhaust pressure measurement (if available) can be used to directly estimate the mass flow through the balance valve. In other examples, assuming again that exhaust pressure measurement is available, the turbine mass fraction flow for each scroll may instead be estimated. Using the exhaust pressure measurement either way will reduce the uncertainty of the model, specifically that of the balance mass flow, $m_{Bal}(p_{3a}, p_{3b}, T_{3a}, u_{Bal})$. This substitution may be particularly useful when a fault is identified. More particularly, if a fault is identified with the balance valve, models relying on the balance valve become unreliable, and a mitigation can be to switch to a modified analysis that omits the balance valve model, which both equations 4 and 5 above rely upon, as discussed below.

For example, mass balance equations can be used to resolve the mass flow as follows. The turbine outlet flow balance can be expressed as:

$$m_{T1}(p_{3a},p_4,T_{3a})+m_{T2}(p_{3b},p_4,T_{3b})-m_{AFT}(p_4,p_0,T_4)=0 \quad \{15\}$$

The flow balance on scroll 1 can expressed as:

$$m_{T1}(p_{3a},\ p_4,\ T_{3a})+m_{EGR}(p_{3a},\ p_2,\ T_{3a},\ u_{EGR})+ m_{Bal}-\frac{1}{2}(m_{Ch}(p_2,\ m_F,\ T_2,\ N_e)+m_F) \quad \{16\}$$

The flow balance on scroll 2 can be expressed as:

$$m_{T2}(P_{3b},\ P_4,\ T_{3b})-m_{Bal}-\frac{1}{2}(m_{Ch}(p_2,\ m_F,\ T_2,\ N_e)+m_F)=0 \quad \{17\}$$

In Equations 16 and 17, $m_{Bal}$ is treated as a freely estimated signal, rather than being modelled as above in Equations 4 and 5. Pressure sensor information can be expressed as:

$$p_{3a}=p_{3a_sensor} \quad \{18\}$$

The augmented vector can then be expressed as $p_{3a}$,$p_{3b}$,$p_4$, $m_{Bal}$.

As an alternative, the system can start with the turbine outlet and aftertreatment (AFT) flow balance:

$$m_T(p_{3a},p_{3b},p_4,T_{3a},T_{3b},T_4)-m_{AFT}(p_4,p_0T_4)=0 \quad \{19\}$$

The balance on scroll 1 is then:

$$(1-\beta)*m_T(p_{3a},\ p_{3b},\ p_4,\ T_{3a},\ T_{3b},\ T_4)+ m_{EGR}(p_{3a},\ p_2,\ T_{3a},\ u_{EGR})-\frac{1}{2}(m_{Ch}(p_2,\ m_F,\ T_2,\ N_E)+m_F)=0 \quad \{20\}$$

Where β indicates the fraction of the total exhaust passing through scroll 1. As represented in Equation 20, the mass flow through scroll 1, plus the EGR mass flow, equals one half of the mass exiting the exhaust manifold of the engine, and is adjusted for balance valve flow using β. The scroll 2 flow balance is shown in Equation 21:

$$\beta*m_T(p_{3a},\ p_{3b},\ p_4,\ T_{3a},\ T_{3b},\ T_4)- \frac{1}{2}(m_{Ch}(p_2,\ m_F,\ T_2,\ N_E)+m_F)=0 \quad \{21\}$$

The resulting augmented vector can be expressed as $p_{3a}$, $p_{3b}$,$p_4$, β. Equations 6 and 7 can be used again to characterize the mass balance; optionally, Equation 7 can be consolidated to reduce the turbine mass flow to a single function expressed as $m_T(p_{3a},p_{3b},p_4,T_{3a},T_{3b},T_4)$ if desired. The EGR mass flow equation can then be modified to use β as shown in Equation 22:

$$m_{EGR}=\frac{1}{2}(m_{Ch}(p_2,\ m_f,\ T_2,\ N_e)+m_F)- (1-\beta)*(m_T(p_{3a},\ p_{3b},\ p_4,\ T_{3a},\ T_{3b},\ T_4) \quad \{22\}$$

The set of equations and variables shown above illustrates the air flow model that can be iteratively solved on an ongoing basis to calculate various pressures, temperatures and air flow in an engine system. The analysis may be referred to as a virtual sensor insofar as several temperatures, pressures and air flow in the system are calculated, rather than being sensed or measured, with the output of the calculations serving as a "virtual" sensor. Test stand operations and other suitable calibrations may be performed to create and/or update coefficients within the airflow model. For example, as components age or are replaced, the model may be rebuilt at a test station and/or the model may be adjusted over time to accommodate aging. For example, a system health monitor may be used to calculate model changes related to component aging, such as by using a function of time, a function of usage, or through measurement or virtual monitoring of changing performance/operation of various components.

An air flow fusion is then used to calculate the air flow. There are two sources: air flow computed from the (filtered) equivalence ratio, which relies on the lambda sensor, and mass balance from the mass flow solver shown above. The lambda sensor is most accurate in steady state, and when the exhaust has a relatively low oxygen content (such as less than 10% oxygen). On the other hand, the mass balance and flow solver are less accurate when the delta between $p_{3a}$ and $p_{3b}$ is small.

The lambda relationship is shown in Equation 23:

$$\lambda=\frac{1}{AFR_{stoich}}\cdot\frac{m_A^{\lambda}}{m_F}. \quad \{23\}$$

As can be seen, the output of the lambda or air-fuel ratio (AFR) sensor will be the mass of the air flow, divided by the mass of fuel, times the inverse of the stoichiometric ratio for the relevant fuel. Rearranging Equation 23, $m_A^{\lambda}$, equals the product of the lambda sensor output, fuel mass, and the stoichiometric ratio for the relevant fuel.

In some examples, air flow fusion can be calculated using a weighted average such as shown in Equation 24, where the value of $m_A$ is determined such that the magnitude of the vector using the two weighting values is minimized:

$$\min_{m_A}\left\|\begin{matrix} w_1\cdot(m_A^{\lambda}-m_A) \\ w_2\cdot(m_A^{T,EGR,Aft}-m_A)\end{matrix}\right\|^2 \quad \{24\}$$

Where the two weights $w_1$ and $w_2$ are each functions of other variables. For example, $w_1$ may be function of the lambda sensor output, as by reducing it in linear fashion from a nominal value to zero as the oxygen content goes from 10% to 5% oxygen (or other function through a similar, wider, or narrower range of oxygen values). If the lambda sensor status is false (such as due to component failure or transient operation), $w_1$ may be set to zero. The other weight, $w_2$, may be a function of the difference between $p_{3a}$ and $p_{3b}$ as calculated in the pressure model of the system; that is, $w_2$ may drop from a nominal value to zero over a range as the difference between $p_{3a}$ and $p_{3b}$ drops below a preset threshold. These constraints on the weighting values may be omitted in some examples.

Figure 3:
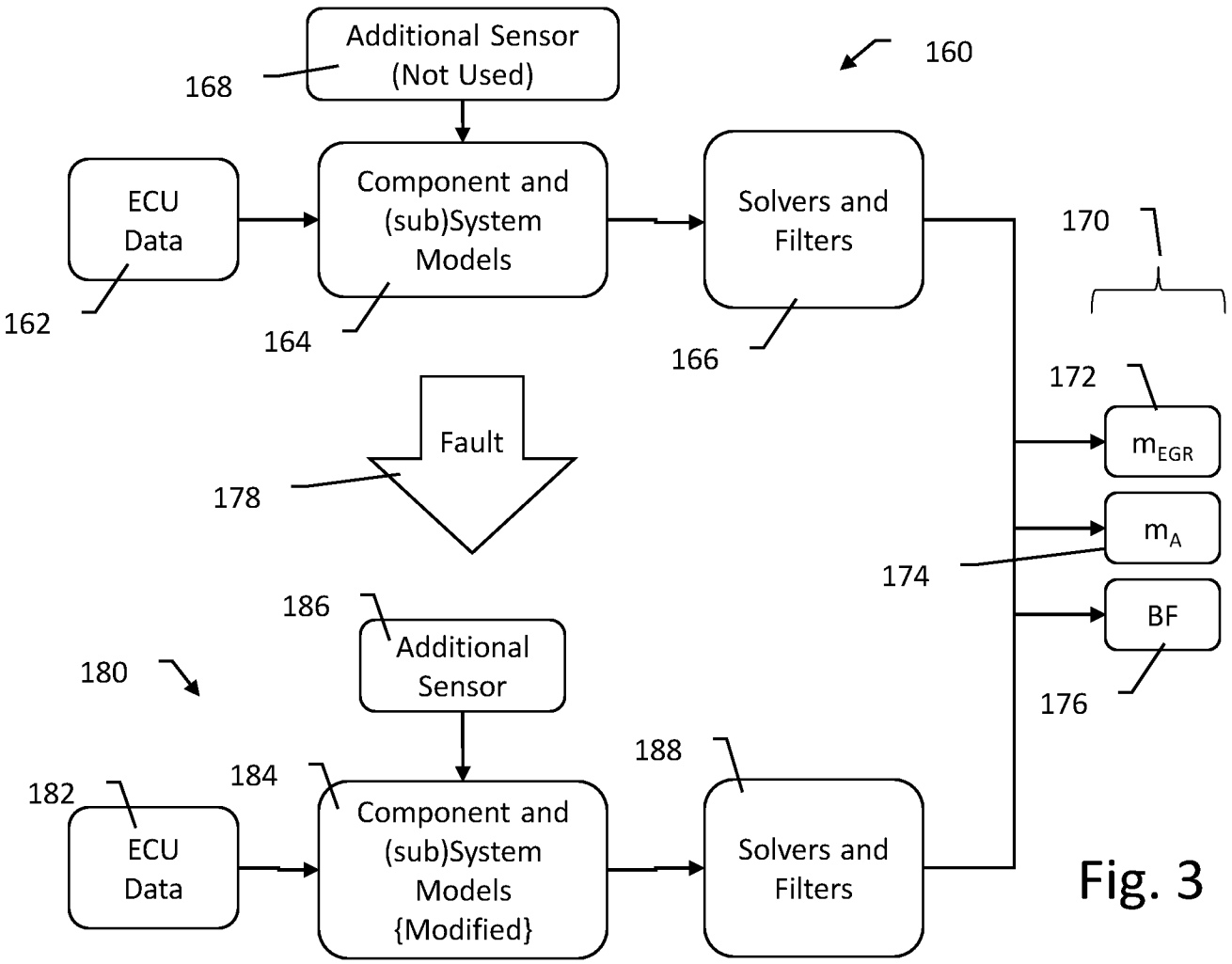
FIG. 3 shows an illustrative example.

FIG. 3 shows an illustrative example of a fault mitigation approach. A nominal operating mode is illustrated at 160. A set of ECU data 162 is provided to a collection of component and sub-system or system models at 164. Component models can be generated for individual componentry of the system. An example may be, for example and without limitation, a model of the flow characteristics in any of the system components such as the compressor, air coolers, EGR valve, wastegate, turbine, and engine, as well as associated linking components therebetween. Such models may be determined on an isolated basis for each component, or may be modeled for subsystem and/or system operation. The preceding discussion of various flow equations provides a detailed sequence and set of examples. The ECU data from 162 is provided to the models, resulting in a set of equations that can be solved using suitable analytical tools as indicated at 166. Any of the above noted solvers and filters may be used for providing a multivariable analysis and non-linear (or linear, as the case may be) analysis performed by the ECU and/or dedicated processors and circuitry to calculate a set of outputs indicated at 170. The illustrative outputs include the EGR valve mass flow 172, the mass air flow 174, and the burned fuel fraction 176.

Additional sensors 168 can be used to augment the analysis as described above where, for example, the normal operation models 164 and/or solvers 166 are capable of generated the outputs at 170 without the "additional" sensors. An example from the above discussion is the exhaust manifold pressure sensor, which may serve as the additional sensor 168, which does not need to be used in the ordinary analysis. The additional sensor(s) 168 can be used as a substitute for an identified faulty component when mitigating the fault.

In the illustrative example, a fault is then identified at indicated at 178, and the system switches to using a different analysis, with the newly implemented analysis 180 configured specifically to the fault 178. A fault may be identified by any suitable means. For example, a stuck or blocked EGR valve can be identified by determining that the EGR valve fails to actuate responsive to a control signal, whether by observation of the valve actuator itself, or by observing a failure of system parameters to change in response to attempted EGR valve actuation. A blocked aftertreatment (AFT) may be identified due to failure of the AFT-related sensors to change values, or an out of range sensor output. A blocked or stuck balance valve may be identified similar to the EGR valve, that is, by directed observation of the actuator failing to respond to a control signal change, or by failure of system parameters to change when the balance valve is actuated. Other analyses may be used, such as by referencing parameters in the virtual model and comparing to expected values or to measured values that deviate from those calculated in the model where a redundant sensor signal is available (turbocharger speed, exhaust manifold pressure, EGR mass flow, etc., depending on which sensors are available). The specific details of how the fault is identified may vary depending on the system.

For example, if the fault identified is a blocked aftertreatment (AFT), a model relying on AFT sensing can be omitted. Using reference to the above numbered equations, Equations 3 (twin scroll turbine) or 10 (single scroll turbine) may be omitted from the set of equations and models used, as those equations rely on the model for aftertreatment flow which is no longer reliable due to the fault. The additional sensor value, such as the exhaust manifold pressure, can be provided to the set of equations instead.

If the fault identified relates to the EGR being blocked or stuck, a model relying on the EGR can be omitted or substituted. Using reference to the above numbered equations, Equations 4 (twin scroll turbine) or 11 (single scroll turbine) may be omitted. The additional sensor value, such as the exhaust manifold pressure, can be provided to the set of equations instead.

If the balance valve of a twin scroll turbine implementation is blocked or stuck, an augmented formulation for computing the mass flows can be implemented. With a twin scroll turbine, Equations 15-18 may be illustratively used and take the place of equations 3-5, with the exhaust manifold pressure, as sensed, incorporated into the analysis as $p_{3a}$. Using $p_{3a}$ allows calculation of the EGR mass flow, which in turn resolves the charge air flow into the engine. Including $m_{Bal}$ as a freely estimated variable facilitates the analysis of Equations 15-18, having a set of four equations with four unknowns ($p_{3a}$, $p_{3b}$, $p_4$ and $m_{Bal}$). Another approach is to use $\beta$ to represent the fraction of the total exhaust passing through scroll 1, as shown in Equations 19-22, resulting in a set of four equations with four unknowns ($p_{3a}$, $p_{3b}$, $p_4$ and $\beta$).

In still another example with the balance valve blocked or stuck, each of an exhaust manifold pressure ($p_{3a}$) and the intake manifold pressure, $p_2$, may be used to calculate the air mass flow using equation 25:

$$m_A = m_{Ch}(p_2, m_f, T_2, N_e) - m_{EGR}(p_{3a}, p_2, T_3, u_{EGR}) \quad \{25\}$$

Thus, here, the charge blow model and EGR valve model flow, both of which can be fed by direct measurement of $p_{3a}$ and $p_2$ are used to characterize the massflow.

The mitigations described above are intended to be illustrative. Other mitigations may be used instead. In some embodiments, it is sufficient that, responsive to an identified fault, one or more analytical models used to calculate airflow in the engine system is underweighted or omitted. Instead of the underweighted or omitted analytical model, a sensed parameter that is not relied upon during the ordinary operation is integrated into the analysis. In some examples, the "not used" sensor may be used for fault identification, if desired.

In another alternative approach, rather than an exhaust manifold pressure sensor, the additional sensor 186 may be the turbocharger speed, which provides both turbine and compressor speeds. Using a turbocharger model and the balance on the turbocharger shaft, the analysis can determine the charge air mass flow as well as the exhaust mass flow (taking into account the effect of VGT or WG operation), and iterative solver can again reduce the problem formulation to four equations and four unknowns.

The newly implemented analysis integrates the "additional" sensor 186 into the analysis. ECU data 182 is provided to the modified set of component and system/subsystem models 184, which also uses the additional sensor data 186. The resulting set of equations is submitted to the solvers and filters at 188 to again provide the same set of outputs 170 as before. The result is that the response to the fault 178 provides the set of system data 170 that allows continued operation of the system even after the fault is identified. It may be that the system operation is ultimately limited in some sense, or less optimized than before, but the system in some examples remains operational within defined limits to avoid the need for complete shutdown due to, for example, violation of emissions or other requirements. That is, with the set of output system data 170 still available after the fault 178, the overall control needed for continued operation within operating limits remains possible until the fault 178 can be resolved in, for example, a subsequent maintenance activity.

The modified analysis can take several forms. In some examples, a set of weighting values are used to determine which of the available analyses are predominant in the system state calculations. Rather than omitting an equation from the analysis, some examples swap new weighting values into the analysis to minimize the impact of one or more models on the outcome analysis. For example, with an Iterated Kalman Filter (IKF) solver, the tuning matrix or measurement covariance matrix can be adjusted to apply large gains to those models that are deemed unreliable, effectively reducing the impact of such models on the output. For other solvers, the weight values can be reduced instead. The effect can be to underweight or effectively omit, for purposes of the solvers being used in a particular implementation, those models that become unreliable due to the identified fault.

While the specific manner of implementing the change is dependent on the type of solver used, the aim is to minimize the impact of a model which, due to an identified fault 178, is no longer reliable, on the analytical outputs 170. Rather than implementing a different solver, or loading an entirely new analysis matrix to the solver, swapping in a new set of gains or weights responsive to the identified fault is used as the mitigation in some examples. Other examples may switch to a different solver, or may reload a distinct set of equations to the solver in place of those previously used, if desired, as mitigation for the fault 178. When the solver is switched, or the equations are swapped, the effect can be to omit, for purpose of the solvers being used in a particular implementation, those models that become unreliable due to the identified fault.

If, at a later time, it is determined that the fault causing a model to become unreliable has ceased (i.e., a stuck valve becomes unstuck, or a blockage of a valve or other component is cleared), the system may revert to the original normal operation described above.

Figure 4A:
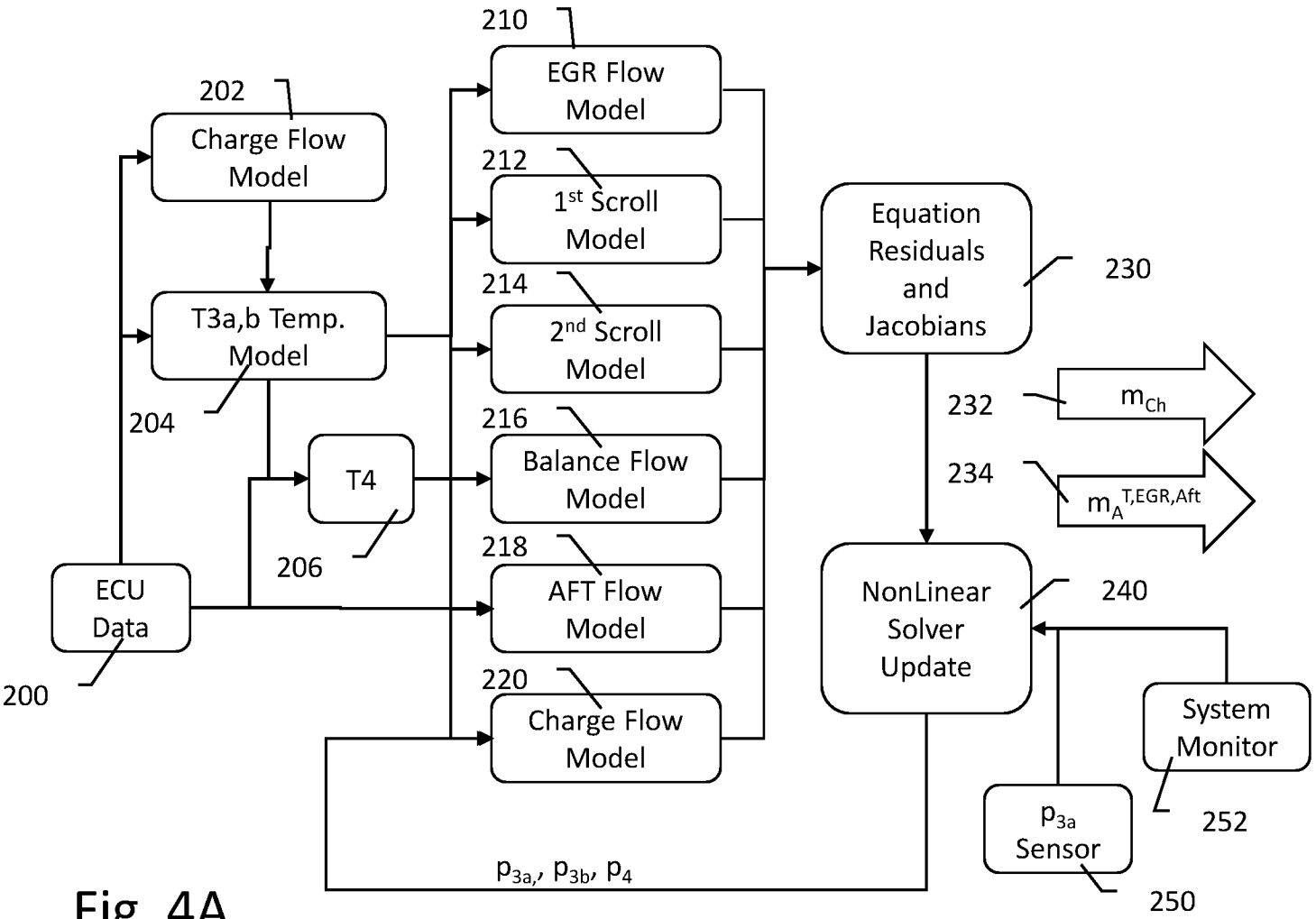
FIGS. 4A-4B show a detailed illustrative example.
Figure 4B:
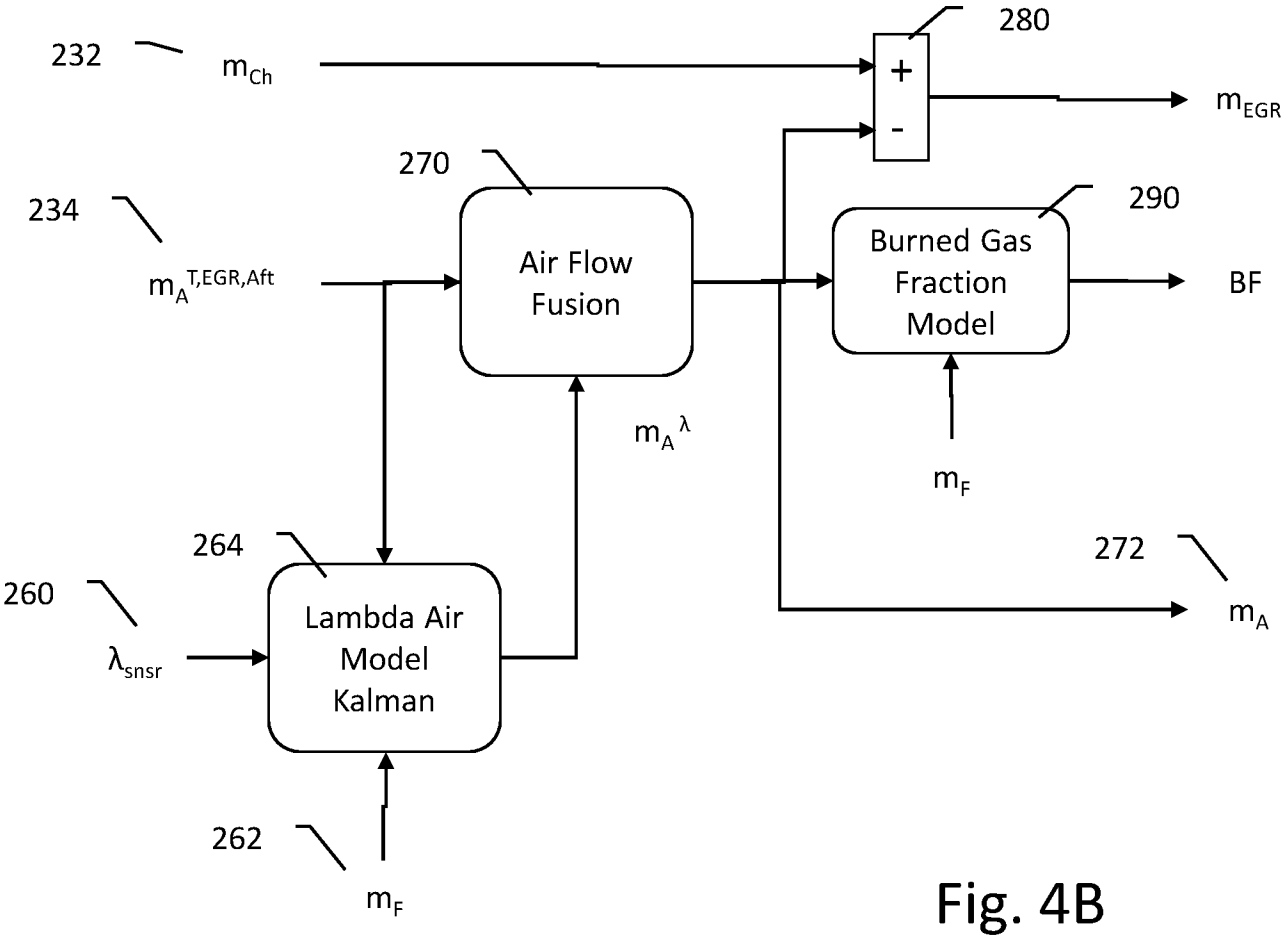

FIGS. 4A-4B show an illustrative analysis in block format. Starting with FIG. 4A, available ECU data at 200 is entered into a charge flow model at 202, and also entered into a temperature model 204 using temperatures $T_{3a}$ and $T_{3b}$, to estimate $T_4$ 206, which may also be measured and provided from the ECU data 200. A set of models formulated as shown above using Eq. 1 and/or Eq. 2 receive the ECU and temperature data, including an EGR Flow model 210, a $1^{st}$ Scroll model 212, a $2^{nd}$ Scroll model 214, a balance flow model 216, an Aftertreatment (AFT) model 218, and a Charge Flow model 220. The coefficients within each model 202, 204, 206, 210, 212, 214, 216, 218, and 220 can be generated on a test stand or under other test conditions for later use in a production design. What will then be output from the set of component models 202, 204, 206, 210, 212, 214, 216, 218, 220 is a set of partial solutions to the airflow model, in the form of equation residuals and Jacobians, as noted at 230 that are fed to the non-linear problem solver 240, which updates with each iteration of the analysis. The non-linear problem solver 240 may be an iterative solver such as a Gauss-Newton, Newton-Raphson, or Iterated Kalman Filter. In the iterative approach, the non-linear solver 240 updates the current system state with estimated values for $p_{3a}$, $p_{3b}$, and $p_4$, as shown which are fed back to the models for use in the next analysis iteration. Meanwhile, the charge mass 232 and the air mass 234 as calculated using the virtual sensor are output for use in FIG. 4B. If available, the equation residuals and Jacobians at 230 may also include the actual sensed pressure $p_{3a}$ 250, though this is optional and the value 250 may be held out of the analysis and instead used for fault mitigation Turning next to FIG. 4B, the charge mass $m_{Ch}$ 232 and the air flow mass $m_A^{T,EGR,Aft}$ 234 as calculated in FIG. 3 are brought forward. The lambda sensor output 260 and fuel mass $m_F$ are provided to a Lambda Air Model Kalman 264, which may be a Kalman filter or extended Kalman filter, to generate the calculated air flow mass $m_A^{\lambda}$ reliant on the lambda filter. The air flow fusion 270 is then performed, using Equation 24, above, generating $m_A$ as one of the solution outputs, as indicated at 272. Simple subtraction at 280 is used to calculate the EGR mass flow $m_{EGR}$, and the burned fuel fraction is calculated at 290.

If a fault is identified, the analysis can return to FIG. 4A. The occurrence of the fault will be identified by the system monitor 252. In response, the system monitor 252 provides a signal and, for example, a reconfiguration command or updated weighting values to the nonlinear solver 240, causing use of the additional sensor, such as p3a 250, or other modification, in the solver analysis in a way that will reduce or effectively eliminate the influence of a now-unreliable model due to the fault. By effectively eliminate, it is meant that the influence of the now-unreliable model is reduced to less than 10%, or less than 5%, or less than 2%, or less than 1%, on the outcome variables from the system that are shown in FIG. 4B.

Figure 5:
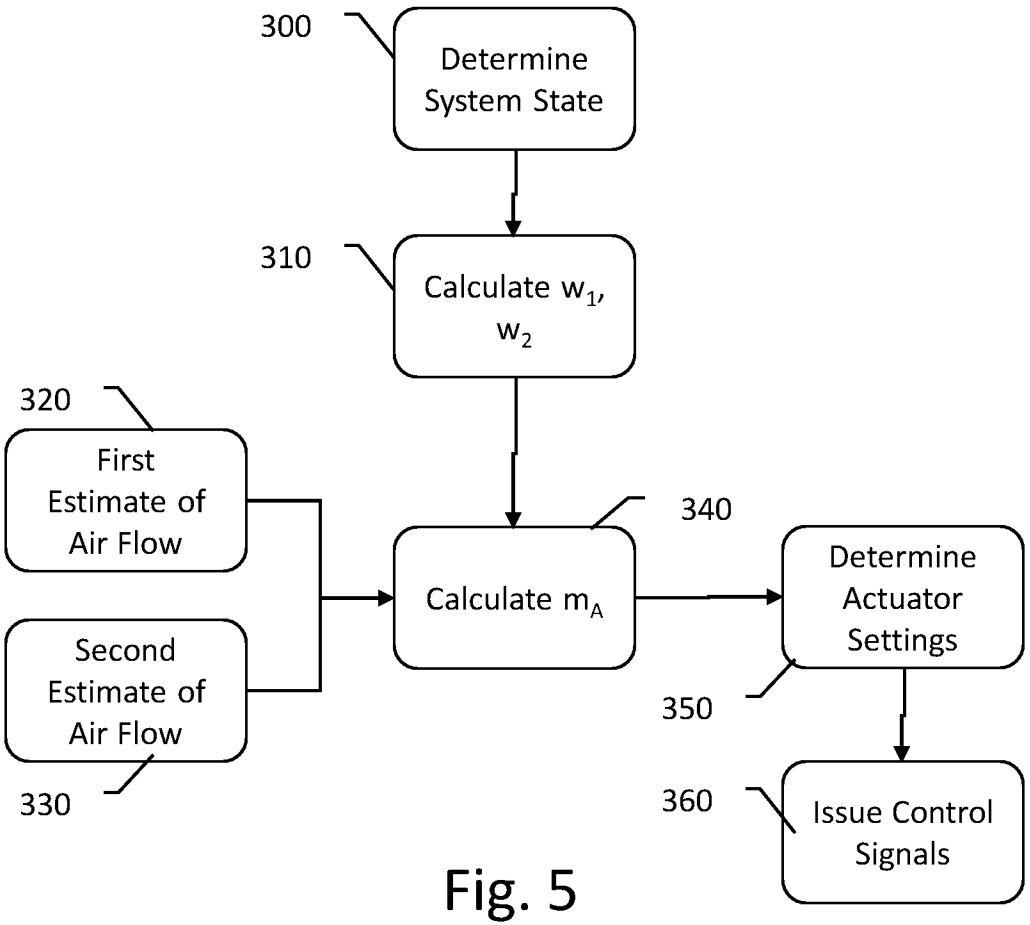
FIG. 5 shows an illustrative air flow fusion method.

FIG. 5 shows an example directed to airflow system control management. Here, system state is determined at 300. The system state is used to calculate the weighting values at 310. A first estimate of mass air flow is calculated at 320, such as by use of a virtual sensor using a set of flow models. A second estimate of mass air flow is calculated at 330, such as by use of the lambda sensor output. The two estimates from 320 and 330 are combined using the two weighting values from 310, to calculate the mass air flow $m_A$ as shown at 340. The resulting set of data is used as shown, for example, in FIG. 4B, to determine overall system air flows. Optimized actuator settings are then determined, as indicated at 350, such as by the use of setpoints, linear quadratic programming, or model predictive control, for example, or other suitable control methodology as are known in the art. Control signals are then generated as indicated at 360. Control signals may, for example, determine position for various valves and actuators in the system, such as the EGR, VNT, RCV, WG, etc. to modify charge air settings, to manage emissions, to control turbocharger speed, and/or to avoid surge, etc.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." Moreover, in the claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic or optical disks, magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, innovative subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the protection should be determined with reference to the appended claims, along with the full scope of equivalents to which such claims are entitled.

What is claimed is:

1. A method of operating an engine system having an engine and an airflow system associated with the engine, the method comprising:

calculating a plurality of parameters within the engine system using a model set including a plurality of models for components within the system, the components including at least a turbocharger having a compressor and a turbine, an exhaust gas recirculation (EGR) valve, and an aftertreatment system including a Lambda sensor, the models including a flow model for the EGR valve, one or more flow models for the turbine, and a charge flow model for air entering an intake manifold of the engine, as part of an ordinary operation of the engine system;

during said ordinary operation of the engine system, using the calculated plurality of parameters to implement a plurality of control signals on components of the engine system;

identifying a fault in a component of the engine system; and responsive to the fault:

calculating the plurality of parameters using a modified model set that omits or underweights at least one of the plurality of models, by incorporating an additional sensed measurement value which is either omitted or underweighted when calculating the plurality of parameters during the ordinary operation; and using the calculated plurality of parameters using the modified model set to implement a plurality of control signals on the components of the engine system.

2. The method of claim 1 wherein the plurality of parameters comprises each of an EGR valve mass flow, a mass of fresh air entering the engine system, and a burned fuel fraction present in exhaust exiting the engine system.

3. The method of claim 1 wherein:

the turbine is a twin scroll turbine;

the engine comprises a first exhaust manifold coupled by a first path to a first section of the twin scroll turbine, and a second exhaust manifold coupled by a second path to a second section of the twin scroll turbine;

a balance valve links the first and second paths;

the first path is coupled to the EGR valve;

the additional sensor is an exhaust manifold pressure sensor; and the one or more flow models for the turbine comprise a first flow model for the first path, a second flow model for the second path, and a balance valve flow model.

4. The method of claim 3 wherein:

the fault is identified in the balance valve; and the reduced model set omits or underweights the EGR flow model.

5. The method of claim 3 wherein:

the fault is identified in the aftertreatment;

the reduced model set omits or underweights the aftertreatment flow balance.

6. The method of claim 3 wherein:

the fault is identified in the EGR valve; and the reduced model set omits or underweights the first flow model for the first path.

7. The method of claim 1 wherein the engine comprises an exhaust manifold, and the additional sensor is an exhaust manifold pressure sensor.

8. The method of claim 1 wherein the engine system comprises a turbocharger having a compressor for compressing air entering the engine, and a turbine for receiving exhaust gasses and obtaining torque to drive the compressor, and the additional sensor is a turbocharger speed sensor.

9. The method of claim 1, wherein identifying the fault comprises observing or sensing whether an actuator has failed to actuate a component controlled by the actuator.

10. The method of claim 1, wherein identifying the fault comprises observing whether actuation of a component fails to cause a change in a sensed or calculated parameter that would otherwise be expected.

11. An engine system comprising:

an engine having an intake manifold and an exhaust manifold, with a combustion chamber therebetween into which a fuel quantity is provided;

an airflow system associated with the engine, the airflow system having at least a turbocharger having a compressor and a turbine, an exhaust gas recirculation (EGR) valve;

an aftertreatment system including a Lambda sensor; and an engine control unit (ECU) storing in a non-transitory memory a plurality of models of components of the engine system including a flow model for the EGR valve, one or more flow models for the turbine, and a charge flow model for air entering the intake manifold of the engine, the ECU configured to operate as follows:

calculating a plurality of parameters within the engine system using a the flow model for the EGR valve, the one or more flow models for the turbine, and the charge flow model for air entering an intake manifold of the engine, as part of an ordinary operation of the engine system;

implementing a plurality of control signals on components of the engine system using the calculated plurality of parameters;

identifying a fault in a component of the engine system; and, responsive to the fault:

calculating the plurality of parameters using a modified model set that omits or underweights at least one of the plurality of models, by incorporating an additional sensed measurement value which is either omitted or underweighted when calculating the plurality of parameters during the ordinary operation; and implementing a plurality of control signals on components of the engine system using the calculated plurality of parameters determined from the modified model set.

12. The system of claim 11 wherein the plurality of parameters comprises each of an EGR valve mass flow, a mass of fresh air entering the engine system, and a burned fuel fraction present in exhaust exiting the engine system.

13. The system of claim 11 wherein:

the turbine is a twin scroll turbine having a first section and a second section;

the engine comprises a first exhaust manifold and a second exhaust manifold;

the airflow system comprises a first airflow path from the first exhaust manifold to the first section of the twin scroll turbine, and a second airflow path from the second exhaust manifold to the second section of the twin scroll turbine, and a balance valve linking the first and second airflow paths;

the first path is coupled to the EGR valve;

the additional sensor is an exhaust manifold pressure sensor; and the one or more flow models for the turbine comprise a first flow model for the first path, a second flow model for the second path, and a balance valve flow model.

14. The system of claim 13 wherein the ECU is configured to identify a fault in the balance valve, and, in response thereto, to use a reduced model set that omits or underweights the EGR flow model.

15. The system of claim 13 wherein the ECU is configured to identify a fault in the aftertreatment, and, in response thereto, to use a reduced model set that omits or underweights the aftertreatment flow balance.

16. The system of claim 13 wherein the ECU is configured to identify a fault in the EGR valve, and, in response thereto, to use a reduced model set that omits or underweights the first flow model for the first path.

17. The system of claim 11, wherein the engine comprises an exhaust manifold, and the additional sensor is an exhaust manifold pressure sensor.

18. The system of claim 11 wherein the engine system comprises a turbocharger having a compressor for compressing air entering the engine, and a turbine for receiving exhaust gasses and obtaining torque to drive the compressor, and the additional sensor is a turbocharger speed sensor.

19. The system of claim 11, wherein the ECU is configured to identify the fault by observing or sensing whether an actuator has failed to actuate a component controlled by the actuator.

20. The system of claim 11, wherein the ECU is configured to identify the fault by observing whether a command issued to actuate a component fails to cause a change in a sensed or calculated parameter that would otherwise be expected.

* * * * *